US010945581B2

(12) United States Patent
Brignone

(10) Patent No.: US 10,945,581 B2
(45) Date of Patent: Mar. 16, 2021

(54) PUMP FOR REGENERATING A DECALCIFYING DEVICE OF A DISHWASHING MACHINE

(71) Applicant: BITRON S.p.A., Turin (IT)

(72) Inventor: Enzo Brignone, Frazione Monastero Dronero (IT)

(73) Assignee: BITRON S.p.A., Turin (IT)

( * ) Notice: Subject to any disclaimer, the term of this patent is extended or adjusted under 35 U.S.C. 154(b) by 348 days.

(21) Appl. No.: 15/736,598

(22) PCT Filed: Jun. 17, 2016

(86) PCT No.: PCT/IB2016/053614
§ 371 (c)(1),
(2) Date: Dec. 14, 2017

(87) PCT Pub. No.: WO2016/203443
PCT Pub. Date: Dec. 22, 2016

(65) Prior Publication Data

US 2018/0132693 A1 May 17, 2018

(30) Foreign Application Priority Data

Jun. 19, 2015 (IT) ..... 102015000025500

(51) Int. Cl.
*F04B 43/04* (2006.01)
*A47L 15/42* (2006.01)
(Continued)

(52) U.S. Cl.
CPC ..... *A47L 15/4229* (2013.01); *F04B 43/04* (2013.01); *F04B 49/10* (2013.01); *D06F 39/007* (2013.01); *F04B 53/10* (2013.01)

(58) Field of Classification Search
CPC ..... F04B 49/10; F04B 53/10; F04B 43/04; D06F 39/007; A47L 15/4229; H02K 33/00–33/18
See application file for complete search history.

(56) References Cited

U.S. PATENT DOCUMENTS 2,332,992 A * 10/1943 Davis ..... B24B 57/00 417/413.1
3,267,867 A * 8/1966 Davis, Jr. ..... F04B 45/047 417/416
(Continued)

FOREIGN PATENT DOCUMENTS

CN 102976443 A 3/2013
EP 411564 A2 * 2/1991 ..... F04B 43/04
(Continued)

OTHER PUBLICATIONS

Communication dated Oct. 8, 2019 by the State Intellectual Property Office of the P.R. of China in application No. 201680035777.9.
(Continued)

*Primary Examiner* — Peter J Bertheaud
*Assistant Examiner* — Dnyanesh G Kasture
(74) *Attorney, Agent, or Firm* — Sughrue Mion, PLLC

(57) ABSTRACT

A pump which brings about a flow of regenerating brine in a chamber containing substances with water-softening properties of a decalcifying device of a dishwashing machine. The pump includes a body (10) in which a brine inflow conduit (16) provided with a one-way valve (18) and a brine outflow conduit (12) provided with a one-way valve (14) are defined; a solenoid (20) arranged within the body (10); and a core controlled by the solenoid (20). The outflow conduit (12) has an initial portion (34) coaxial with the axis (24) of the solenoid so that, when the pump is not active, the mouth of the initial portion (34) is closed by the center portion of
(Continued)

the membrane (44) which ensures the water-tightness in both directions between the inflow and outflow conduits (16, 12).

11 Claims, 6 Drawing Sheets

(51) Int. Cl.

| | |
|---|---|
| ***F04B 49/10*** | (2006.01) |
| *D06F 39/00* | (2020.01) |
| *F04B 53/10* | (2006.01) |

(56) References Cited

U.S. PATENT DOCUMENTS

| | | | | | |
|---|---|---|---|---|---|
| 3,514,228 | A * | 5/1970 | Toyoda | F04B 53/1037 | 417/416 |
| 3,776,666 | A * | 12/1973 | Ludwig | F04B 15/00 | 417/411 |
| 3,877,070 | A * | 4/1975 | Takenouchi | G11B 5/48 | 360/78.02 |
| 3,906,294 | A * | 9/1975 | Lourigan | H01F 7/08 | 361/196 |
| 4,219,863 | A * | 8/1980 | Takeshima | H01F 7/1615 | 361/156 |
| 4,635,683 | A * | 1/1987 | Nielsen | H01F 7/13 | 137/625.65 |
| 4,818,191 | A * | 4/1989 | Schlake | F01L 25/08 | 417/390 |
| 5,127,625 | A * | 7/1992 | Kleinhappl | F16K 31/06 | 251/129.17 |
| 5,722,367 | A * | 3/1998 | Izydorek | F02M 3/09 | 123/339.13 |
| 5,765,538 | A * | 6/1998 | Krimmer | C07K 14/4703 | 123/516 |
| 5,785,298 | A * | 7/1998 | Kumar | F16K 31/0655 | 251/129.16 |
| 7,051,991 | B2 * | 5/2006 | Suzuki | F16K 7/14 | 215/331 |
| 7,766,037 | B2 * | 8/2010 | Moenkhaus | F16K 31/0655 | 137/556.3 |
| 8,900,118 | B2 * | 12/2014 | Birk | A61F 5/0056 | 128/897 |
| 2008/0272208 | A1 * | 11/2008 | Anderson | B65D 83/262 | 239/302 |
| 2011/0057601 | A1 * | 3/2011 | Hiltbold | H02P 1/42 | 318/729 |
| 2015/0247585 | A1 * | 9/2015 | Takanishi | F16K 27/041 | 251/129.15 |

FOREIGN PATENT DOCUMENTS

| | | | |
|---|---|---|---|
| EP | 1 497 491 | B1 | 12/2012 |
| EP | 2 564 752 | A | 3/2013 |
| JP | 56-63863 | U | 5/1981 |
| JP | 57-141686 | U | 9/1982 |
| JP | 3-206378 | A | 9/1991 |
| JP | 2005-522290 | A | 7/2005 |
| JP | 2012-92777 | A | 5/2012 |
| WO | 93/20370 | A1 | 10/1993 |
| WO | 2015/086630 | A1 | 6/2015 |

OTHER PUBLICATIONS

International Search Report for PCT/IB2016/053614 dated Sep. 26, 2016.

* cited by examiner

PUMP FOR REGENERATING A DECALCIFYING DEVICE OF A DISHWASHING MACHINE

CROSS REFERENCE TO RELATED APPLICATIONS

This application is a National Stage of International Application No. PCT/IB2016/053614 filed Jun. 17, 2016, claiming priority based on Italian Patent Application No. 102015000025500 filed Jun. 19, 2015, the contents of all of which are incorporated herein by reference in their entirety.

BACKGROUND OF THE INVENTION

Field of the Invention

The present invention relates to the field of dishwashing machines and in particular of devices for decalcifying the mains water which is supplied thereto.

Background

As is known, a decalcifying device comprises a chamber containing substances with water-softening properties, in particular ion exchange resins, through which the water supplied to the dishwashing machine is made to pass so that it is decalcified.

After a certain number of washes, depending on the hardness of the mains water supplied, it is necessary to regenerate the exchange resins by treating them with a regenerating brine produced in a salt reservoir.

According to known methods, for example those described in EP 2 564 752 and EP 1 497 491, the inflow of the brine into the chamber containing substances with water-softening properties is controlled by means of a pump, such as a membrane-type pump, which is positioned on a conduit connecting the salt reservoir to the aforementioned chamber.

In particular, EP 2 564 752 describes a membrane-type or peristaltic pump activated by a gear motor, the specific structure of which is not even outlined and which imparts a reciprocating motion to a piston connected to the respective membrane, such that no part of the gear motor is connected to the membrane. The gear motor is moreover housed in a casing which is clearly separate from the body in which the respective brine inflow/outflow conduits are formed, such that no part of the gear motor is associated to said body.

In any case, these known pumps are rather noisy and, when they are not active, do not ensure water-tightness in the two directions of flow.

SUMMARY OF THE INVENTION

It is an object of the present invention to provide a membrane-type pump which, despite being cost-effective, is nevertheless able to prevent the aforementioned disadvantages of the prior art.

According to the invention, this object is achieved by a pump having the features indicated specifically in claim 1 hereinbelow. Preferred features of the invention are specified in the dependent claims.

The present invention further relates to a decalcifying device for a dishwashing machine which comprises a pump of the aforementioned type.

BRIEF DESCRIPTION OF THE DRAWINGS

Further advantages and features of the present invention will become apparent from the detailed description which follows, provided purely by way of non-limiting example and with reference to the accompanying drawings, in which.

DETAILED DESCRIPTION OF THE INVENTION

Figure 1:
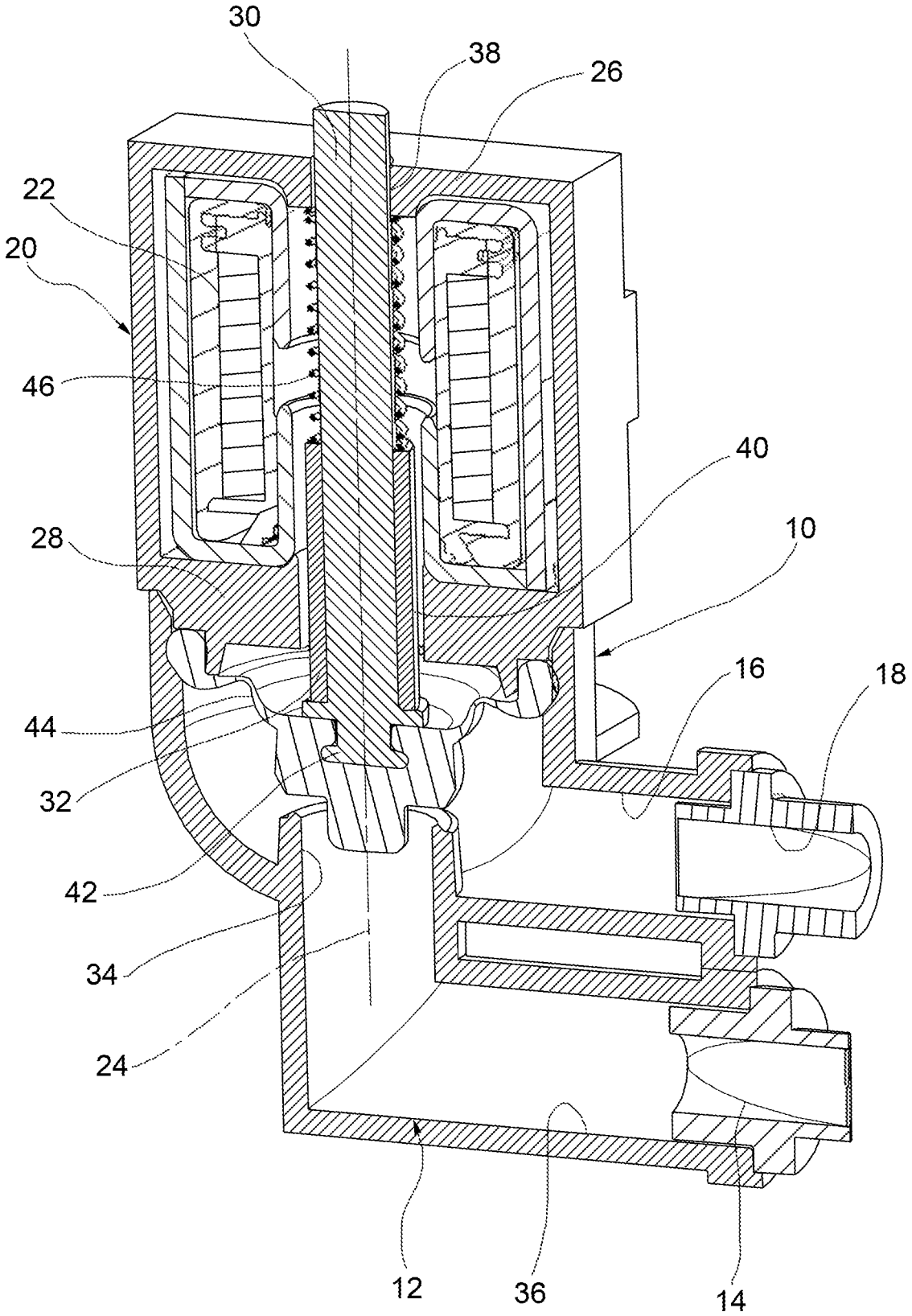
FIG. 1 is a schematic sectional view of a pump of the invention in a first configuration.
Figure 2:
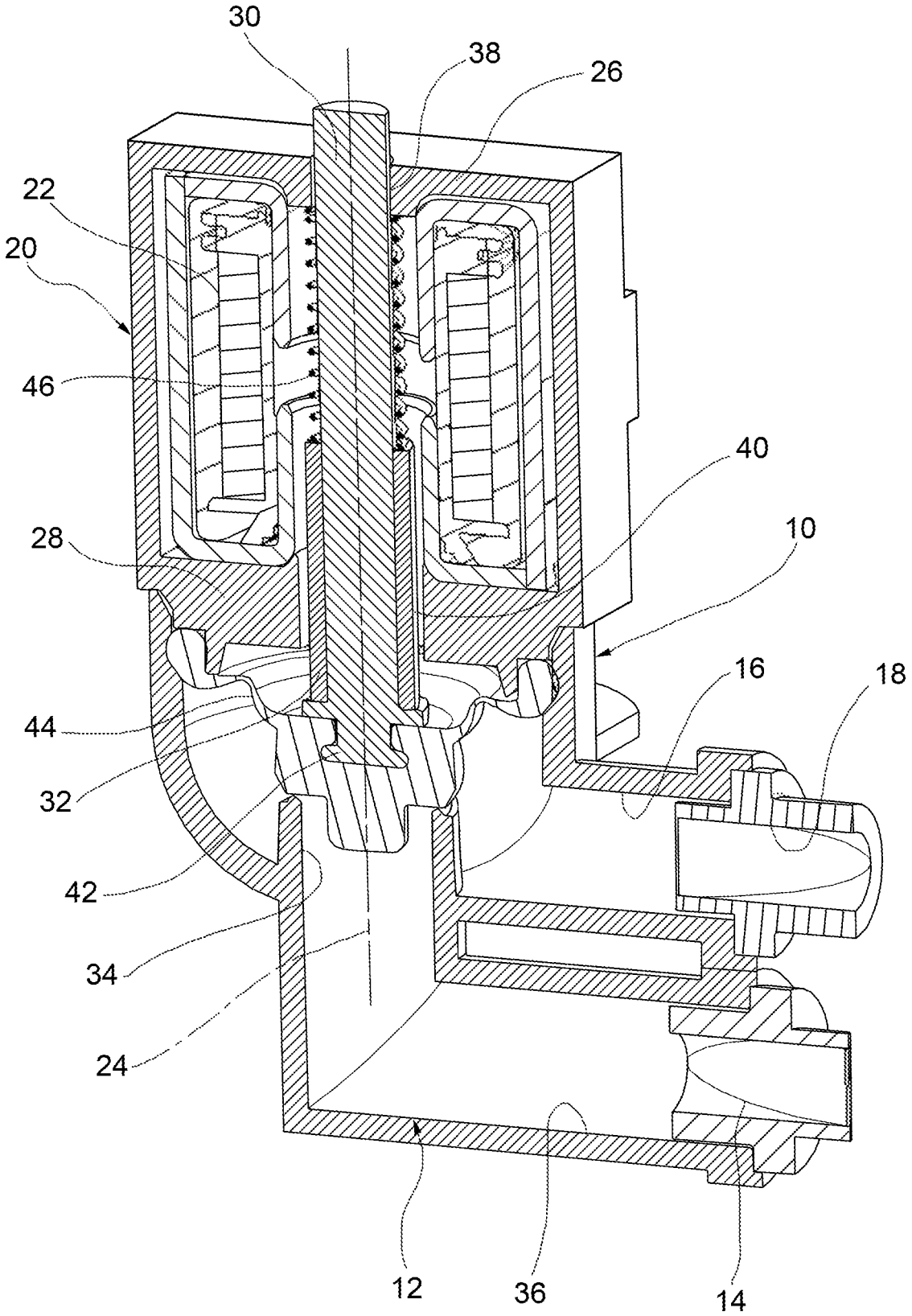
FIG. 2 is a schematic sectional view of the pump shown in FIG. 1 in a second configuration.

A pump (FIGS. 1 and 2) comprises a body 10, typically of plastics material, in the lower portion of which an inflow conduit 16 provided with a one-way valve 18 and an outflow conduit 12 provided with a one-way valve 14 are defined. As is shown in the figures, the conduits 12, 16 are offset. In a manner which is known per se and not shown in the figures, the inflow conduit 16 is connected to a salt reservoir in which a regenerating brine is formed, whereas the outflow conduit 12 is connected to a chamber containing substances with water-softening properties of a decalcifying device of a dishwashing machine.

At the top, the body 10 comprises a hollow case 20, preferably of plastics material, within which a solenoid 22 having a vertically oriented longitudinal axis 24 is housed. The case 20 is shaped substantially in the manner of a parallelepiped and has, inter alia, an upper wall 26 and a lower wall 28 parallel to one another.

A core is mobile along the axis 24 and, in general, has a part of plastics material which is slidingly associated to the body 10 and to which a member of magnetic material, such as iron, capable of interacting with the electromagnetic field generated by the solenoid 22 is assembled/co-moulded. In the shown embodiment of the invention, the core is formed by a bar 30 of plastics material, whose lower portion is surrounded by a sleeve 32 of magnetic material fixed to the bar 30. In an alternative embodiment of the invention which is not shown in the figures, a member of magnetic material may be incorporated, for example by means of co-moulding, within the bar 30 of plastics material. An initial portion 34 of the outflow conduit 12 is moreover coaxial with the downward continuation of the axis 24, and forms a right angle with a subsequent portion 36 which is parallel with the inflow conduit 16.

The bar 30 of the core has an upper end associated to the case 20 through a passage 38 formed in the wall 26, which acts as upper guide of the movement of said core. Analogously, the wall 28 of the case 20 is provided with a further passage 40 acting as lower guide of the movement of the sleeve 32 of the core. The bottom surface of the bar 30 has a T-shaped projection 42 connected to a centre portion of a membrane 44, the peripheral portion of which is fixed to the body 10.

A helical spring 46, which acts as return elastic means of the core, is arranged coaxially around the upper portion of the bar 30 between the upper end of the sleeve 32 and the lower surface surrounding the passage 38 of the wall 26 of the case 20.

Figure 3:
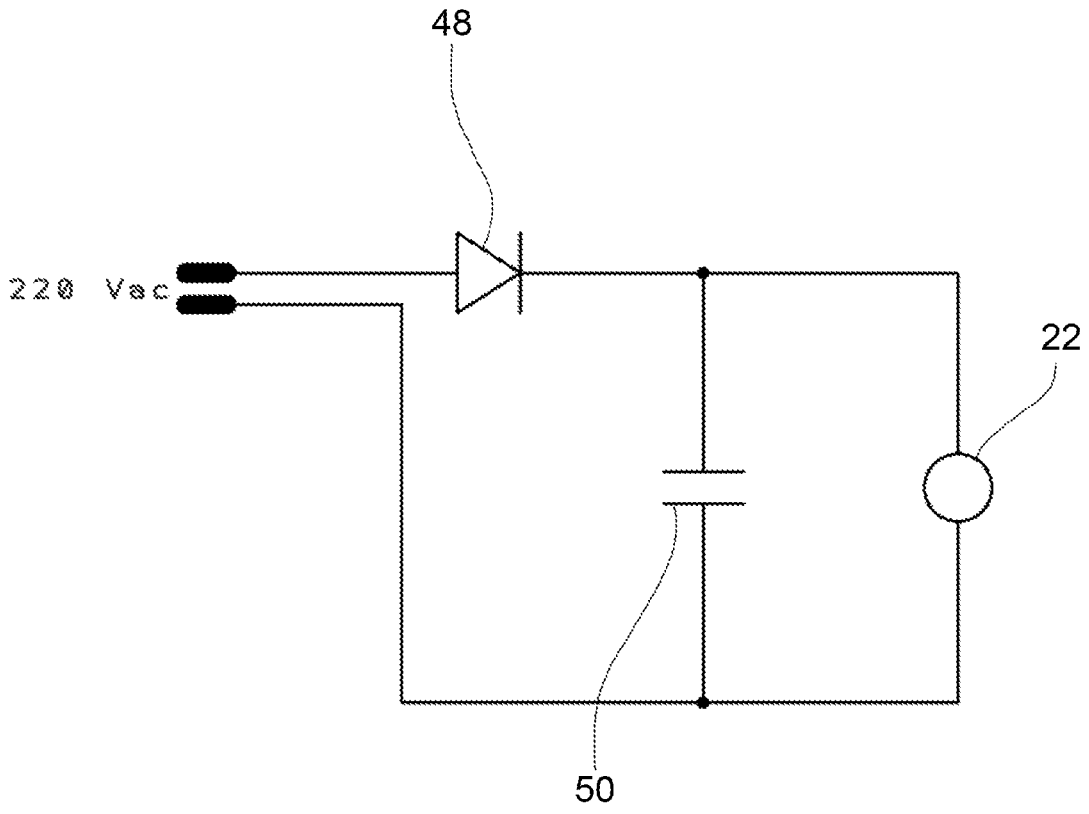
FIG. 3 is a schematic view of the electrical circuit of the pump of the invention.

FIG. 3 shows the electrical supply circuit of the solenoid 22. As is shown therein, the alternating supply current passes through a half-wave rectifier diode 48. In addition, a capacitor 50, preferably having a capacity not greater than 3 μF (as well as not zero), is arranged in parallel to the solenoid 22 to attenuate the supply current.

During operation of the pump (FIG. 1), the flow of electric current through the solenoid 22, together with the return action of the spring 46, causes a reciprocating movement of the core to which the membrane 44 is connected, thereby activating the flow of the brine from the inflow conduit 16 towards the outflow conduit 12. As is shown in the figures, the movement of the core takes place in air, such as to avoid a priori a situation in which said core may come into contact with the pumped liquid. This movement is very silent since the coupling of the core with the upper and lower guides described above may be realized with high precision. The silent nature of the movement is further promoted by the features of the electrical supply circuit of the solenoid 22, which tend to dampen induced vibrations.

When the pump is not active (FIG. 2), the mouth of the initial portion 34 of the outflow conduit 12 is closed by the centre portion of the membrane 44 which ensures the water-tightness in both directions between the inflow and outflow conduits 16, 12.

Figure 4:
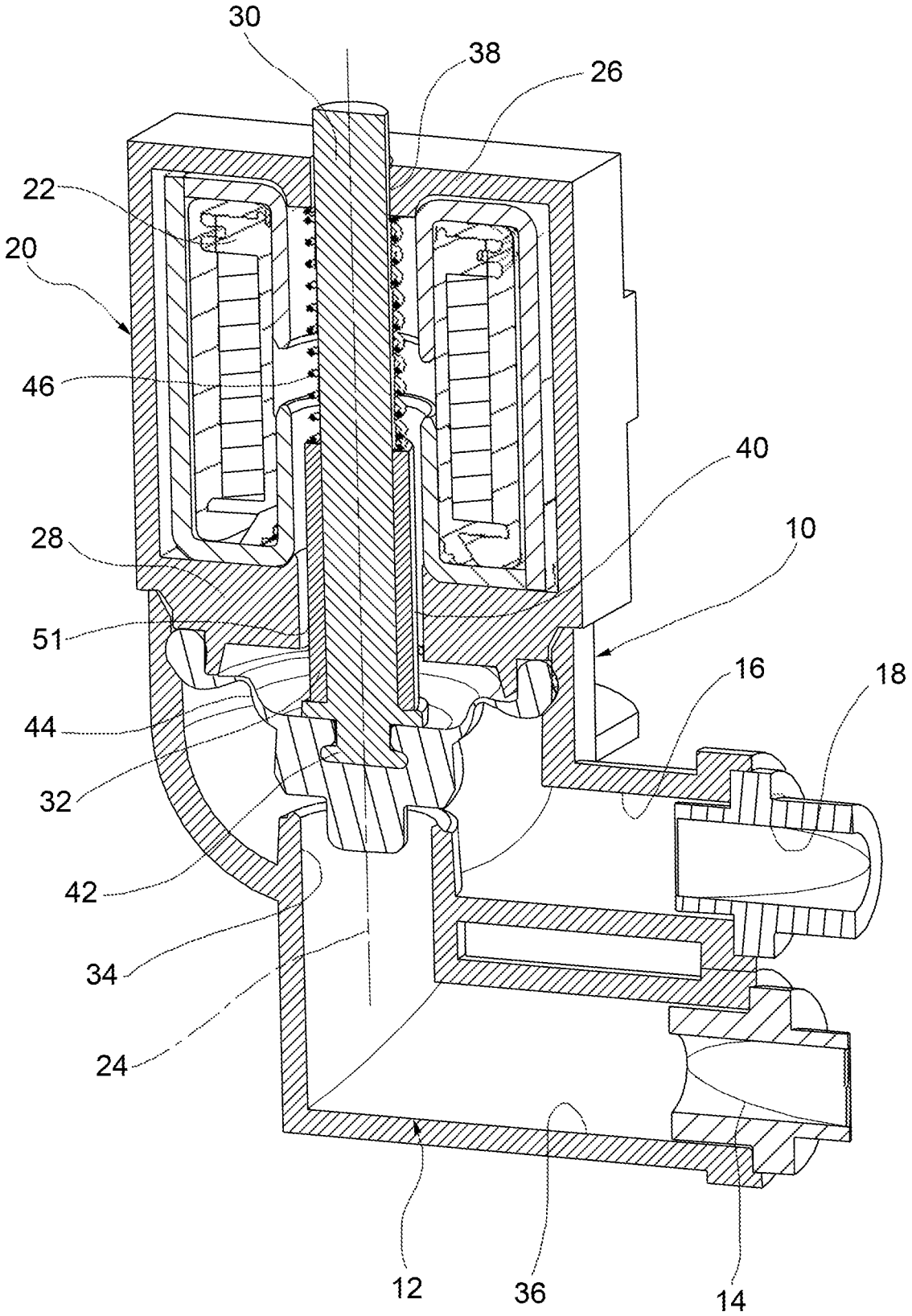
FIGS. 4 to 6 are schematic views of respective further embodiments of the pump of the invention.

FIG. 4 shows an alternative embodiment of the pump of the invention, in which numerals identical to those used in the preceding figures denote identical or equivalent parts.

The only difference with respect to the pump described above consists in the fact that the membrane 44 also acts as lower guide of the movement of the core, which—contrary to that shown above—passes with not insignificant play 51 through the passage 40 formed in the lower wall 28 of the case 20.

Figure 5:
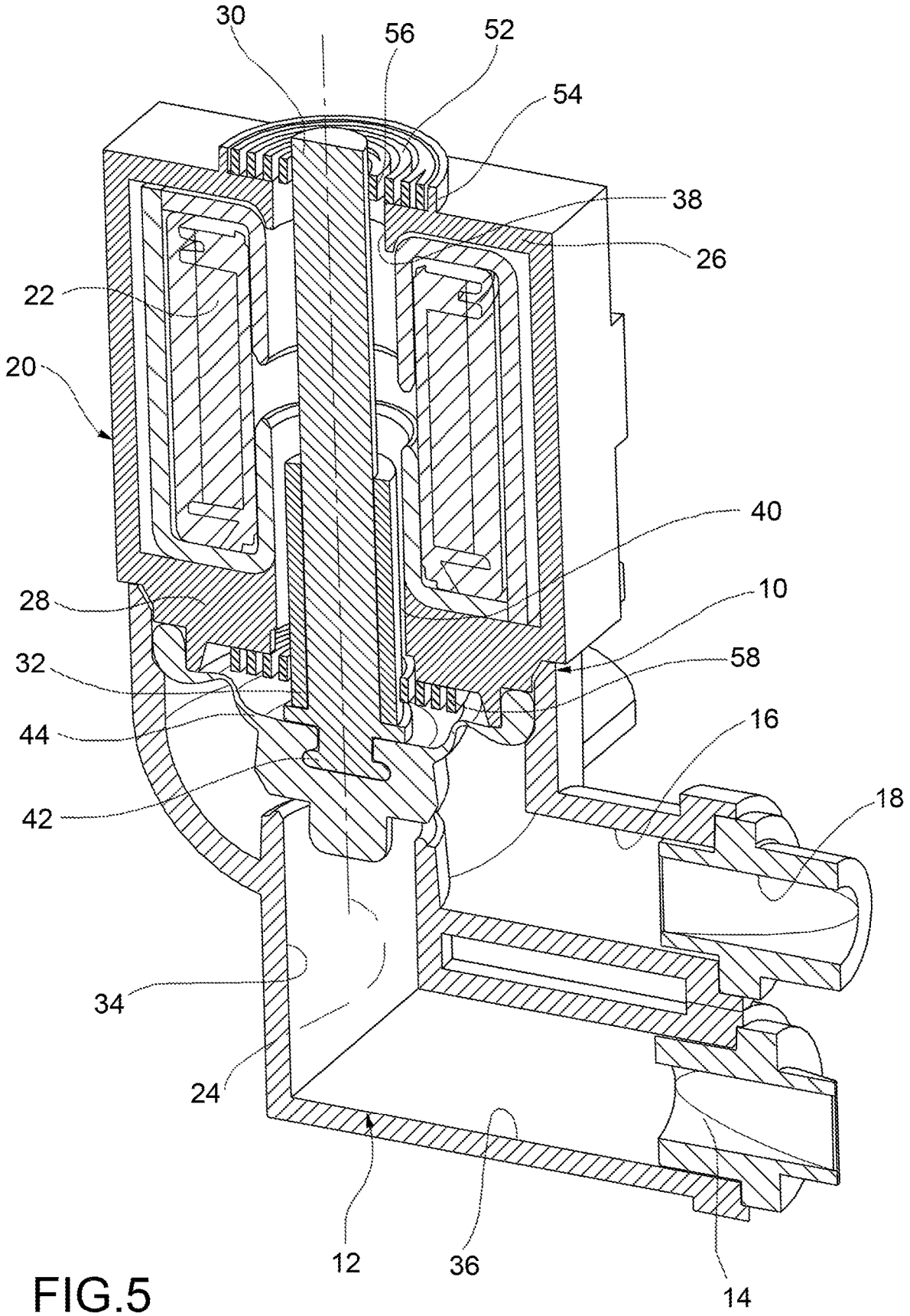

FIG. 5 shows a further alternative embodiment of the pump of the invention, in which numerals identical to those used in the preceding figures denote identical or equivalent parts.

In this case, the return elastic means consist of a first spiral spring 52 having a first end fixed to a circumferential projection 54 protruding from the upper wall 26 of the case 20 and a second end 56 fixed to the bar 30 of the core. The spring 52 also acts as upper guide of the movement of the core.

In addition, a second spiral spring 58 is fixed to the outside of the lower wall 28 of the case 20 and acts as lower guide of the movement of the core.

Figure 6:
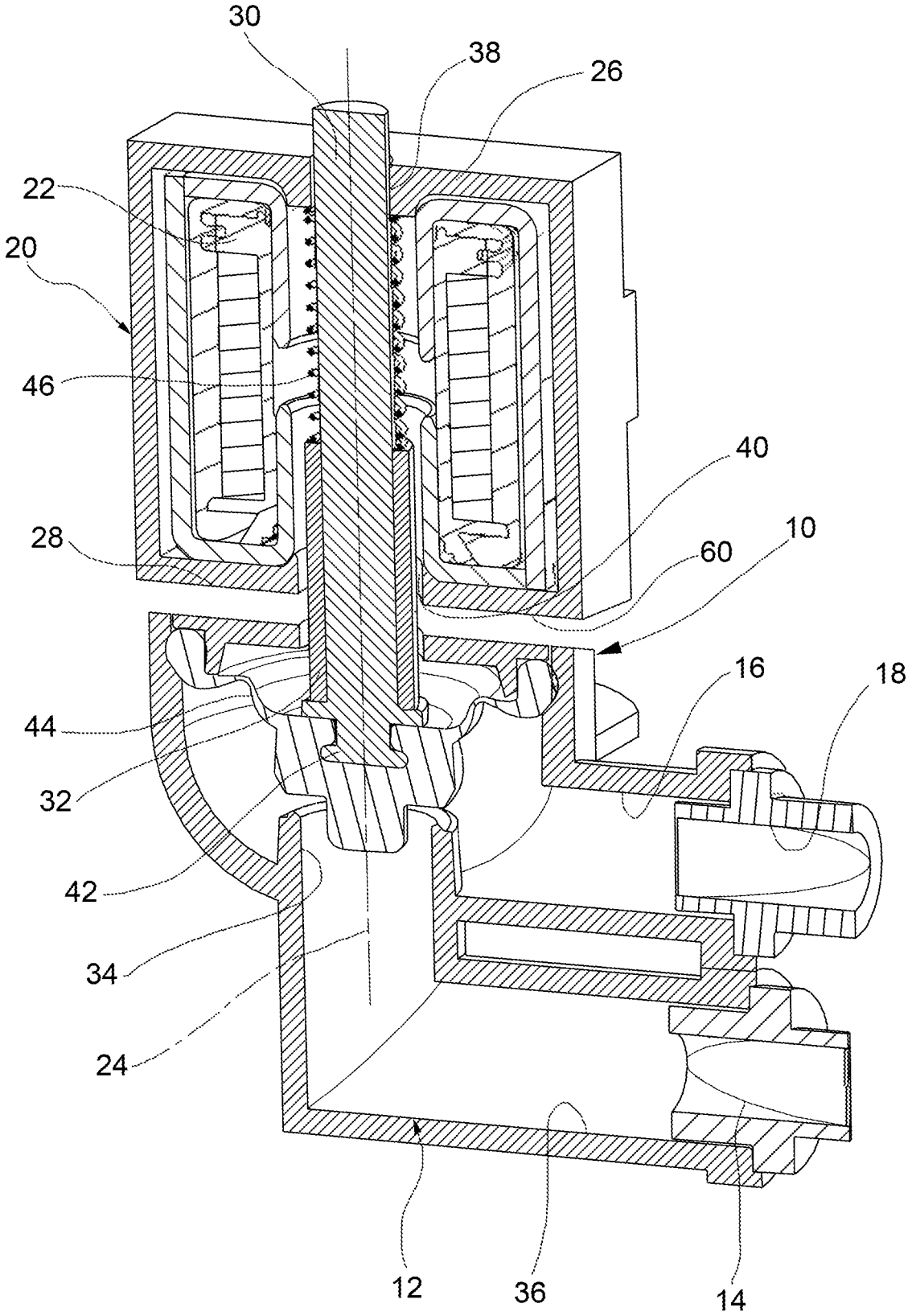

FIG. 6 shows yet another alternative embodiment of the pump of the invention, in which numerals identical to those used in the preceding figures denote identical or equivalent parts.

In this case, a safety conduit 60 for discharging the brine is formed in the body 10. In the case of accidental breakage of the membrane 44, the brine can be discharged through the conduit 60 without coming into contact with the electromagnetic parts of the pump, thereby avoiding the risk of damaging them.

Clearly, without departing from the principle of the invention, the constructional details and the embodiments may be greatly varied with respect to that described purely by way of example, without thereby departing from the scope of the invention as defined in the accompanying claims. In particular, a pump according to the present invention can be used in any desired decalcifying device with or without a monolithic body of plastics material, the hydraulic circuit of which provides that the step of regenerating the ion exchange resins is activated by a pump positioned on a conduit for connecting the salt reservoir, in which the regenerating brine is formed, to the resin-containing chamber.

The invention claimed is:

1. A pump for bringing about a flow of regenerating brine in a chamber containing substances with water-softening properties of a decalcifying device of a dishwashing machine, comprising:

a body (10) in which a brine inflow conduit (16) provided with a one-way valve (18) and a brine outflow conduit (12) provided with a one-way valve (14) are defined, a solenoid (20) having a longitudinal axis (24) and arranged within said body (10), and a core controlled by said solenoid (20), mobile along said longitudinal axis (24), provided with return elastic means and having an upper end associated to said body (10) and a lower end connected to a center portion of a membrane (44), whose peripheral portion is fixed to said body (10), wherein said core has a part of plastics material which is associated to the body (10) and to which a member of magnetic material is assembled, wherein said outflow conduit (12) has an initial portion (34) coaxial with said longitudinal axis (24) so that, when the pump is not active, the mouth of said initial portion (34) is closed by said center portion of the membrane (44) which ensures the water-tightness in both directions between said inflow and outflow conduits (16, 12), and wherein said body (10) comprises a monolithic hollow case (20) which delimits an inner cavity, within which said solenoid (22) is housed and which has an upper wall (26) having a through passage (38) acting as upper guide of the movement of said core protruding outside said inner cavity, wherein said core is formed by a bar (30) of plastics material, whose lower portion is surrounded by a sleeve (32) of magnetic material, and wherein said return elastic means comprises a helical spring (46) coaxially arranged around the bar (30) of the core between the upper end of said sleeve (32) and a lower surface of the upper wall (26) of the hollow case (20), wherein the bar (30) has an upper end within said through passage (38) of said hollow case (20), so that said spring (46) is entirely within said inner cavity and around said bar (30).

2. The pump according to claim 1, wherein said core is mobile in air and is never in contact with the flow of brine.

3. The pump according to claim 1, wherein said hollow case is plastic.

4. The pump according to claim 1, wherein the part of plastics material which is associated to the body (10) is co-molded with the member of magnetic material.

5. The pump according to claim 1, wherein said hollow case (20) has a lower wall (28) having a passage (40) acting as lower guide of the movement of said core.

6. The pump according to claim 1, wherein said membrane (44) acts as lower guide of the movement of said core.

7. The pump according to claim 1, wherein the electric current supplying said solenoid (22) passes through a diode (48), so that it is rectified to only one half-wave.

8. The pump according to claim 7, wherein an electric capacitor (50) is arranged in parallel to said solenoid (22).

9. The pump according to claim 8, wherein said electric capacitor (50) has a capacity not greater than 3 μF.

10. The pump according to claim 1, wherein the body (10) is provided with a safety conduit (60) for discharging the brine in the case of breakage of the membrane (44).

11. A decalcifying device for a dishwashing machine, comprising a pump according to claim 1.

* * * * *